US007634866B2

(12) United States Patent
Javorsky

(10) Patent No.: US 7,634,866 B2
(45) Date of Patent: Dec. 22, 2009

(54) GUN SITE HAVING REMOVABLE ADJUSTABLE MODULES

(75) Inventor: Myron Javorsky, Prerov (CZ)

(73) Assignee: Meopta optika s.r.o., Prerov (CZ)

( * ) Notice: Subject to any disclaimer, the term of this patent is extended or adjusted under 35 U.S.C. 154(b) by 100 days.

(21) Appl. No.: 12/043,500

(22) Filed: Mar. 6, 2008

(65) Prior Publication Data

US 2008/0216379 A1 Sep. 11, 2008

Related U.S. Application Data

(60) Provisional application No. 60/893,920, filed on Mar. 9, 2007.

(51) Int. Cl.
*F41G 1/033* (2006.01)

(52) U.S. Cl. ..... 42/111; 42/115

(58) Field of Classification Search ..... None
See application file for complete search history.

(56) References Cited

U.S. PATENT DOCUMENTS

| | | | | | |
|---|---|---|---|---|---|
| 4,554,745 | A * | 11/1985 | Repa | ..... | 42/126 |
| 5,363,559 | A * | 11/1994 | McCarty | ..... | 42/122 |
| 5,369,888 | A * | 12/1994 | Kay et al. | ..... | 42/113 |
| 5,383,278 | A * | 1/1995 | Kay | ..... | 33/265 |
| 6,705,037 | B2 * | 3/2004 | Van Kirk | ..... | 42/126 |
| 6,802,129 | B1 * | 10/2004 | Wirth | ..... | 33/265 |
| 6,925,721 | B2 * | 8/2005 | Dietz | ..... | 33/265 |

* cited by examiner

*Primary Examiner*—Michael Carone
*Assistant Examiner*—Reginald Tillman, Jr.
(74) *Attorney, Agent, or Firm*—Levine & Mandelbaum

(57) ABSTRACT

A gun sight including a lens through which a target may be viewed and a light source for directing a point of light toward the lens, the point of light being reflected by the lens toward the viewer. The location of the reflected point of light with respect to the viewer along both windage and elevation axis is adjustable, and elevation and windage modules for permitting the adjustments are removable from the remainder of the gun sight without disturbing the adjusted and windage elevation settings.

10 Claims, 3 Drawing Sheets

GUN SITE HAVING REMOVABLE ADJUSTABLE MODULES

BACKGROUND OF THE INVENTION

This invention relates to gun sights which are mounted on guns for the purpose of aiding the user in aiming the gun at a target. More particularly, the invention relates to such a sight provided with means for adjusting the elevation and windage of the sight with respect to the weapon upon which it is mounted.

Conventionally, the means for adjusting elevation and windage of a gun sight form a permanent part of the sight. Consequently, the adjustment elements remain on the gun, along with the sight, even though the adjustment elements are rarely needed once the sight is initially adjusted.

BRIEF SUMMARY OF THE INVENTION

According to the present invention, windage and elevation adjustment is accomplished by means of modules which are removable from the sight after the adjustments have been made.

Since the present invention employs elevation and windage adjustment modules which are removable from the sight after the sight has been properly adjusted with respect to the gun on which it is mounted, the adjustment modules need not be carried by the gun and sight when they are not needed. The advantage of this arrangement is that once the adjustment modules are removed, the weight of the gun is reduced. In addition, the possibility of inadvertently altering the adjustments is avoided.

BRIEF DESCRIPTION OF THE DRAWINGS

The invention will be described in more detail with reference to the accompanying drawings, in which.

DETAILED DESCRIPTION OF THE INVENTION

Figure 1:
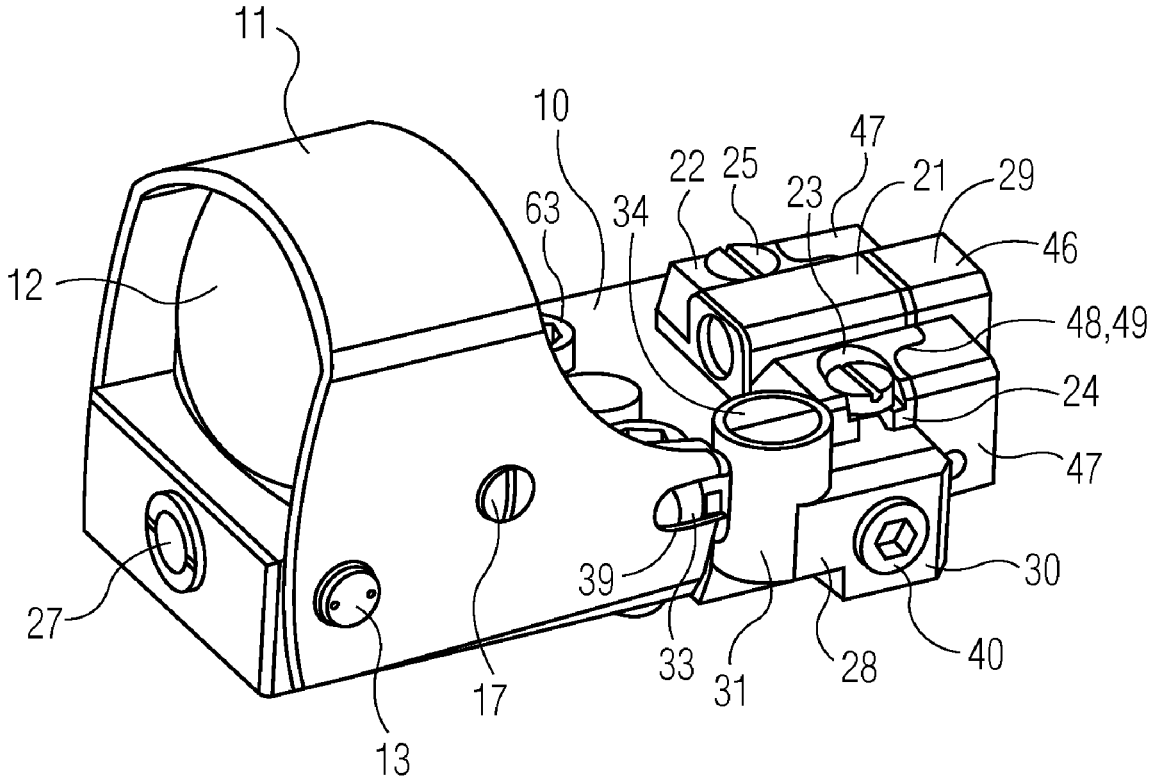
FIG. 1 is a perspective view, from the front and one side, of a gun sight according to the present invention.

The invention will be described in connection with a so-called "red dot" sight. In such a sight, a lens and a light source, e.g., an LED unit, are spaced apart along the axis of the gun. The lens is partially reflective so that the target can be seen through the lens, and simultaneously the lens reflects back to the user the light emitted by the LED in the form of a red dot.

The gun sight chosen to illustrate the present invention, and shown in FIGS. 1-4 includes a platform 10 carrying an inverted U-shaped lens holder 11. Supported within lens holder 11 is a lens arrangement 12. Preferably, the lens arrangement is of a known design including two concavo-convex lenses in face-to-face contact sandwiching between them a partial reflection film. Lens holder 11 is pivotally mounted on platform 10 by means of two pins 13 passing through the vertical walls of the lens holder and into the platform. This permits an adjustment of the red dot to be made along a vertical elevation axis by moving the lens holder about the horizontal axis defined by the two pins 13.

A bracket 15 (FIGS. 3 and 4), having two upstanding ears 16 is fixed to the upper surface of platform 10. Each ear is formed with an elongated slot (not shown) and is positioned adjacent to the inner surface of one of the vertical walls of lens holder 11. Each wall of the lens holder has a hole aligned with the elongated slot in its respective ear 16. A locking screw 17 passes through the hole in the lens holder and the slot in the adjacent ear and is threaded into a nut 18 adjacent to the inner face of the ear. Once the elevation adjustment has been made, by tilting lens holder 11 around pivot pins 13, the lens holder is locked in place by tightening each pair of locking screws 17 and nuts 18.

Also carried by platform 10 is a light-emitting diode (LED) unit 21. The LED emits a red point of light in the direction of lens arrangement 12. The red light is reflected, by the partially reflective lens arrangement, back to the user. The LED unit 21 includes a housing having two lateral arms 22 each formed with a U-shaped slot 23 positioned over two internally threaded holes (not shown) in platform 10. Each slot 23 has an inwardly projecting ledge 24 adjacent to the upper surface of platform 10. A locking screw 25 is accommodated by each slot 23, the shaft of the locking screw (not shown), being threaded into the respective hole in platform 10 with which slots 23 are aligned. The space between the arms of U-shaped ledge 24 is smaller than the diameter of the locking screw head 25, so that when the locking screws are tightened, the heads of the screws press down on ledges 24 to fix the LED unit in place on platform 10.

With locking screws 25 in a loosened condition, LED unit can be shifted laterally to move the red dot along a horizontal windage axis so as to perform the windage adjustment. After the adjustment has been made, screws 25 are tightened to hold the LED unit firmly in place on platform 10.

Stored within the hollow interior of platform 10 are a battery and associated circuitry for operating the LED. A button 27 (FIGS. 1 and 2) at the front of the platform is used to turn the LED on and off, and may also be used to vary the brightness of the light emitted by the LED.

Adjustment of elevation and windage are accomplished by means of an elevation module 28 and a windage module 29, respectively.

The elevation module 28 (best seen in FIG. 2) includes a bracket portion 30 integral with a cylindrical housing 31. The wall of housing 31 is formed with a vertically elongated slot 32 through which a finger 33 having a rounded tip projects externally from inside the housing. Finger 33 can be moved up and down by rotating the head 34 of an adjustment screw (not shown) accommodated within housing 31. Surrounding head 34, on the upper circular edge of housing 31, is a series of equally spaced-apart markings 35. Extending diametrically across adjustment screw head 34 is a slot 36 for accommodating a screwdriver blade, or like tool, for the purpose of rotating head 34 in either direction. By rotating head 34, finger 33 is moved up or down. Markings 35, viewed in coordination with the position of slot 36, provide an indication of the distance through which head 34 has been rotated, and hence the distance through which finger 33 has been moved.

Lens holder 11 is formed with a notch 39 adapted to accommodate finger 33. The location of finger 33 within notch 39 causes lens holder 11 to pivot about pins 13 in response to up and down movement of finger 33. Thus, by rotating adjustment screw head 34, resulting in movement of finger 33 and pivotal movement of lens holder 11, the gun sight is subjected to elevation adjustment. In other words, this movement of the lens holder changes the point on the lens arrangement 12, in a vertical direction, from which the red dot is reflected back to the user.

Figure 2:
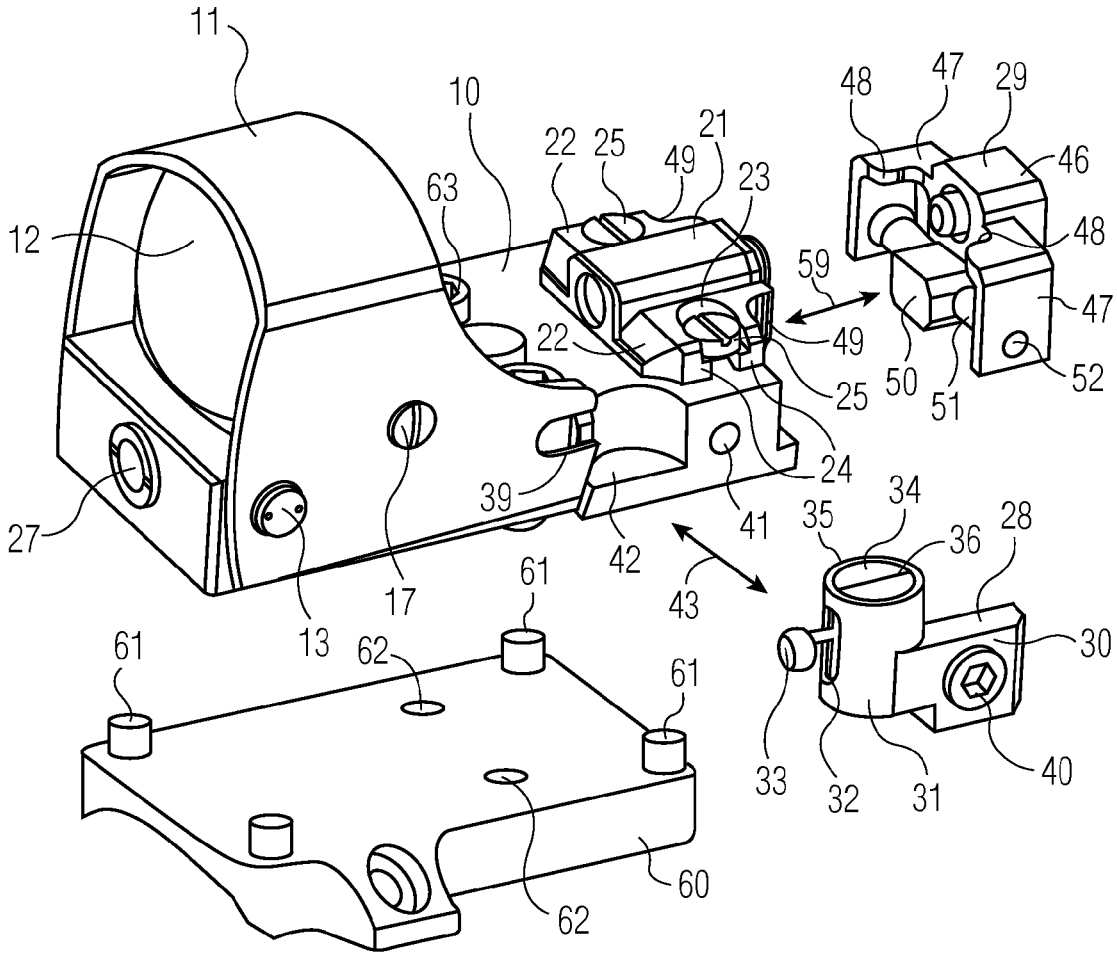
FIG. 2 is an exploded perspective view, similar to FIG. 1, showing the elevation and windage modules, and a mounting plate, removed from the sight.
Figure 3:
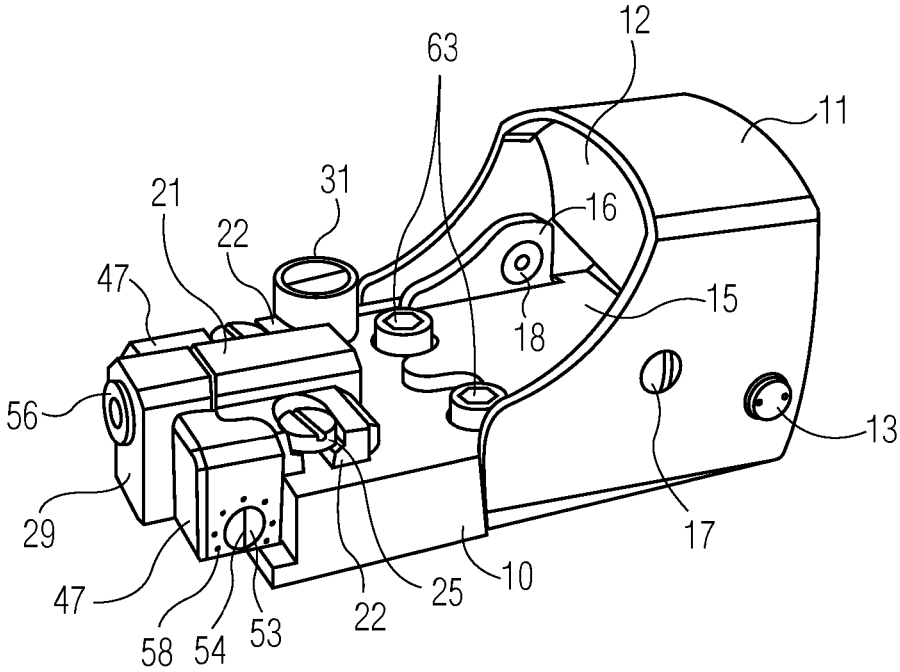
FIG. 3 is a perspective view of the gun sight, from the rear and one side, with the elevation and windage modules in place on the sight.
Figure 4:
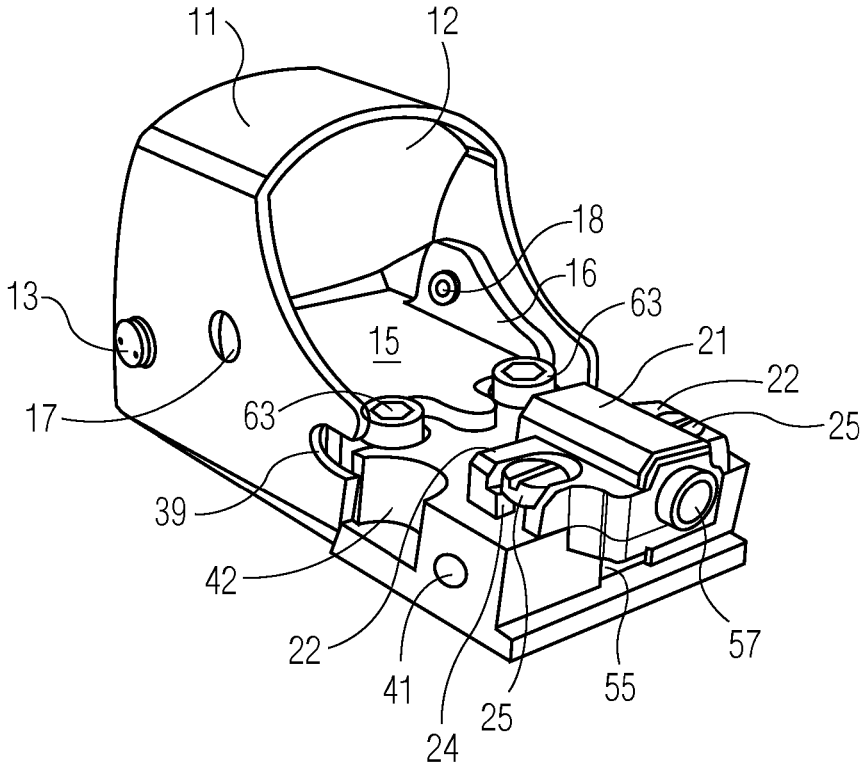
FIG. 4 is a perspective view, from the rear and the other side of the gun sight, with the adjustment modules having been removed.

Elevation module 28 is attached to platform 10 by means of a mounting screw 40 (FIGS. 1 and 2). Mounting screw 40 passes through bracket portion 30 and threads into a hole 41 in the platform. Thus, to attach elevation module 28 to platform 10 of the gun sight, housing 31 is fit into a semi-circular cavity 42 (FIGS. 2 and 4) in the platform, so that finger 33 is received within notch 39. Mounting screw 40 is then rotated to tightly join the elevation module to the platform. To remove the elevation module, mounting screw 40 is rotated in the opposite direction to unthread it from hole 41 permitting the module to be slipped in a horizontal direction away from platform 10. These movements of the elevation module to and from the platform 10 is indicated by the double-headed arrow 43.

The windage module 29 (best seen in FIG. 2) includes a central body 46 flanked by two shoulders 47. The front edges of shoulders 47 are sculpted at 48 to mesh with similarly sculpted edges 49 at the rear face of LED unit 21.

Between shoulders 47 is a lug 50 (FIG. 2) having an internally threaded through hole into which a threaded adjustment rod 51 is threaded. Rod 51 extends the full distance between the two shoulders 47, one end 52 of rod 51 being rotatably captured in one of the shoulders. The other end of rod 51 is formed with a head 53 (FIG. 3) carrying a screwdriver slot 54. A serious of equi-distantly spaced markings 58 on the respective shoulder 47 surround head 53.

It will be appreciated that as threaded rod 51 is rotated, by means of a screwdriver or similar tool engaging slot 54, lug 50 will move horizontally back and forth between shoulders 47. The back edge of platform 10 is formed with an indentation 55 (FIG. 4) within which lug 50 is accommodated when windage module 29 is mounted on platform 10. The cooperation between lug 50 and indentation 55 prevents lug 50 from moving with respect to platform 10. Therefore, when threaded rod 51 is rotated, the remainder of windage module 29 will be moved horizontally with respect to platform 10, and due to the cooperation of sculpted shoulders 48 and 49, the LED unit will be moved horizontally with respect to platform 10. The movement of the LED unit changes the point, in a horizontal direction, on the lens arrangement 12 from which the red dot is reflected back to the user.

Windage module 29 is secured to LED unit 21 by means of a mounting screw 56 (FIG. 3) which is threaded into an internally threaded bore 57 (FIG. 4) in the LED unit. To remove the windage module, mounting screw 56 is unscrewed from bore 57, permitting the module to be moved in a horizontal direction away from LED unit 21. The movement of module 29 toward and away from the LED unit is indicated by the double-headed arrow 59 in FIG. 2.

To mount the sight of the present invention on a gun, the upper surface of the gun has secured to it a conventional mounting rail (not shown), such as a rail distributed by Weaver Outdoor Optics, a division of Meade Instruments Corp. Secured to the mounting rail is a mount interface plate 60 (FIG. 2) provided in its corners with four short upstanding posts 61. Plate 60 is also furnished with two internally threaded holes 62. The bottom face of platform 10 is furnished with four holes (not shown) arranged in a rectangular pattern so that they accommodate the four posts 61 of plate 60. When mounting the sight on the gun, it is placed upon plate 60 so that the posts 61 enter the holes in the lower face of platform 10, and two mounting screws 63, located within through holes in platform 10, are rotated to thread them into holes 62 and securely attach the sight to platform 60.

Once the sight is mounted on the gun, the user aims by looking through sight and bringing the red dot reflected from the lens arrangement over the target. A test shot is then fired at a target. Depending on the results of the test shot, the head of elevation adjustment screw 34 is rotated to swing lens holder 11 up or down, so as to adjust the vertical position of the red dot provided by LED unit 21 on lens arrangement 12. Also, head 53 of adjustment rod 51 is rotated so as to slide the LED unit 21 horizontally and thereby adjust the position of the red dot on lens 12 in the windage direction. Using additional test shots and elevation and windage adjustments, the correct location of the red dot on lens 12 is achieved. At that point, locking screws 17 are tightened to secure lens holder 11 in position with respect to platform 10, and locking screws 25 are tightened to fix the LED unit to platform 10. Then, elevation module 28 is removed from the sight by unscrewing mounting screw 40 from hole 41, and windage module 29 is removed by unscrewing mounting screw 56 from hole 57.

One advantage of a sight according to this invention is that it may be made quite small, i.e., having a length of about two inches, and a width and height of about one inch. This makes it ideal for use on pistols as well as longer barrel weapons.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

The invention claimed is:

1. A gun sight comprising:

A lens through which a target may be viewed, means for directing a point of light toward the lens, the point of light being reflected by the lens toward the viewer, and means for adjusting the location of the reflected point of light with respect to the viewer along both windage and elevation axes, said adjusting means being removable from the remainder of the gun sight without disturbing the adjusted windage and elevation settings.

2. A gun sight as defined in claim 1 wherein the adjusting means includes:

means for moving the lens to alter the location of the reflected point of light with respect to the viewer along one of a windage and elevation axis, and means for moving the light-directing means to alter the location of the reflected point of light with respect to the viewer along the other of the windage and elevation axes, the two moving means being operable independently of each other.

3. A gun sight as defined in claim 2 wherein the two moving means are removable, independently of each other, from the remainder of the gun sight.

4. A gun sight comprising:

a lens through which a target may be viewed, the lens being adjustable with respect to a first axis a light source for directing a point of light toward the lens, the point of light being reflected by the lens toward the viewer, and the light source being adjustable with respect to a second axis, and individual modules associated with the lens and light source respectively, for adjusting the lens and light source independently of each other, the modules being removable from the lens and light source, respectively, without disturbing the adjustments of the lens and light source with respect to their respective axes.

5. A gun sight as defined in claim 4 including:

a platform, a lens holder mounted on the platform for movement about the first axis, the lens being carried by the lens holder, a housing mounted on the platform for movement along the second axis, the light source being carried by the housing.

6. A gun sight as defined in claim 5 wherein movement of the lens holder about the first axis serves as the elevation adjustment of the gun sight, and movement of the light source housing along the second axis serves as the windage adjustment of the gun sight.

7. A gun sight as defined in claim 5 wherein the individual modules include an elevation module and a windage module, the elevation module including means for pivoting the lens holder about the first axis, and the windage module including means for moving the light source housing along the length of the second axis.

8. A gun sight as defined in claim 7 wherein the first axis is horizontal, and the elevation module includes a member movable vertically with respect to the platform, the member engaging the lens holder to pivot the lens housing about the horizontal first axis so as to adjust the elevation setting of the gun sight.

9. A gun sight as defined in claim 7 wherein the second axis is horizontal and spaced from the first axis, and the windage module includes a body movable horizontally with respect to the platform, the body engaging the light source housing to move that housing along the horizontal second axis so as to adjust the windage setting of the gun sight.

10. A gun sight comprising:

a platform suitable for mounting on a gun, a lens holder pivotally mounted on the platform for pivotal movement about a first horizontal axis, a lens, carried by the lens holder, through which the target may be viewed, the lens being partially reflective, an elevation module having a member movable vertically in response to rotation of an adjustment screw carried by the elevation module, the lens holder having means cooperating with the member for pivoting the lens holder in response to vertical movement of the member, means for removably mounting the elevation module on the platform, a housing mounted on the platform for movement with respect to the platform along a second horizontal axis spaced from the first axis, a light source, carried by the housing, for directing a point of light at the lens, the point of light being reflected by the lens toward the viewer, a windage module having a body movable horizontally in response to rotation of a threaded adjustment rod carried by the windage module, the body engaging the light source housing to move the latter horizontally along the second axis, and means for removably mounting the windage module on the platform.

* * * * *